US011367559B2

(12) United States Patent
Sato et al.

(10) Patent No.: US 11,367,559 B2
(45) Date of Patent: Jun. 21, 2022

(54) MULTILAYER COIL COMPONENT

(71) Applicant: TDK CORPORATION, Tokyo (JP)

(72) Inventors: Takahiro Sato, Tokyo (JP); Hitoshi Kudo, Tokyo (JP); Takashi Suzuki, Tokyo (JP); Kouichi Kakuda, Tokyo (JP); Tatsuro Suzuki, Tokyo (JP); Hiroyuki Tanoue, Tokyo (JP)

(73) Assignee: TDK CORPORATION, Tokyo (JP)

( * ) Notice: Subject to any disclaimer, the term of this patent is extended or adjusted under 35 U.S.C. 154(b) by 828 days.

(21) Appl. No.: 16/227,167

(22) Filed: Dec. 20, 2018

(65) Prior Publication Data

US 2019/0198227 A1 Jun. 27, 2019

(30) Foreign Application Priority Data

Dec. 26, 2017 (JP) ..... JP2017-248865

(51) Int. Cl.

| | |
|---|---|
| ***H01F 27/28*** | (2006.01) |
| ***H01F 1/34*** | (2006.01) |
| ***H01F 3/10*** | (2006.01) |
| ***H01F 17/00*** | (2006.01) |
| ***H01F 27/29*** | (2006.01) |

(52) U.S. Cl.

CPC ..... *H01F 27/2804* (2013.01); *H01F 1/344* (2013.01); *H01F 3/10* (2013.01); *H01F 17/0013* (2013.01); *H01F 27/292* (2013.01); *H01F 2003/106* (2013.01); *H01F 2027/2809* (2013.01)

(58) Field of Classification Search

CPC ..... H01F 17/0013; H01F 2027/2809; H01F 17/0006; H01F 27/2804; H01F 5/003; H01F 27/29; H01F 27/292; H01F 1/344; H01F 2003/106

USPC ..... 336/200, 232

See application file for complete search history.

(56) References Cited

U.S. PATENT DOCUMENTS

| | | | | |
|---|---|---|---|---|
| 2014/0333405 | A1 | 11/2014 | Choto et al. | |
| 2017/0345552 | A1 * | 11/2017 | Nakano | H01F 27/2804 |

FOREIGN PATENT DOCUMENTS

| | | | | | |
|---|---|---|---|---|---|
| CN | 104143404 | A | | 11/2014 | |
| JP | 3228790 | B2 | | 11/2001 | |
| JP | 2005-123450 | A | | 5/2005 | |
| JP | 2005123450 | A | * | 5/2005 | |
| JP | 2014-220469 | A | | 11/2014 | |
| JP | 2017-212372 | A | | 11/2017 | |
| WO | WO-2009130935 | A1 | * | 10/2009 | H01F 17/0013 |

* cited by examiner

*Primary Examiner* — Tszfung J Chan

(74) *Attorney, Agent, or Firm* — Oliff PLC

(57) ABSTRACT

The inventors have newly found that, even when a composition of a first element body portion and a composition of a second element body portion are different from each other, a high bonding strength at an interface between the first element body portion and the second element body portion can be obtained when both the first element body portion and the second element body portion contain $Zn_2SiO_4$ as a constituent component. That is, when the first element body portion and the second element body portion contain $Zn_2SiO_4$, a bonding strength at the interface is improved compared to a case in which the first element body portion and the second element body portion do not contain $Zn_2SiO_4$.

8 Claims, 6 Drawing Sheets

MULTILAYER COIL COMPONENT

CROSS-REFERENCE TO RELATED APPLICATIONS

This application is based upon and claims the benefit of priority from Japanese Patent Application No. 2017-248865, filed on 26 Dec. 2017, the entire contents of which are incorporated herein by reference.

TECHNICAL FIELD

The disclosure relates to a multilayer coil component.

BACKGROUND

Conventionally, a multilayer coil component having a multilayer coil provided in a ferrite element body is known. For example, a multilayer coil component in which ferrite element bodies of two types having different compositions are disposed in an axial direction of a coil so that impedance characteristics thereof can be adjusted is disclosed in Japanese Patent No. 3228790 (Patent Document 1).

SUMMARY

A configuration in which ferrite element bodies of two types are disposed as in the multilayer coil component according to the conventional art described above is obtained by calcination in a state in which green sheets of two types having different compositions are overlapped and integrated. At the time of calcining, since the green sheets of two types having different compositions have different thermal expansion coefficients and shrinkage rates, it is difficult to secure a bonding strength at an interface between the ferrite element bodies, and a technology for improving the bonding strength is desired.

According to the disclosure, a multilayer coil component in which a bonding strength at an interface between ferrite element bodies is improved is provided.

A multilayer coil component according to one aspect of the disclosure is a multilayer coil component having a multilayer coil provided in a ferrite element body, in which the ferrite element body has a first element body portion, and a second element body portion adjacent to the first element body portion and having a composition different from a composition of the first element body portion, and both the first element body portion and the second element body portion contain $Zn_2SiO_4$ as a constituent component.

The inventors have newly found that, when both the first element body portion and the second element body portion contain $Zn_2SiO_4$ as a constituent component, a bonding strength at the interface between the first element body portion and the second element body portion is improved compared to a case in which the first element body portion and the second element body portion do not contain $Zn_2SiO_4$. That is, in the above-described multilayer coil component, since both the first element body portion and the second element body portion contain $Zn_2SiO_4$ as a constituent component, a bonding strength at the interface between the first element body portion and the second element body portion can be improved.

The multilayer coil component according to another aspect may further include a buffer layer interposed between the first element body portion and the second element body portion. In this case, the bonding strength between the first element body portion and the second element body portion can be further improved.

In the multilayer coil component according to another aspect, a $Zn_2SiO_4$ content rate of the first element body portion may be higher than a $Zn_2SiO_4$ content rate of the second element body portion.

In the multilayer coil component according to another aspect, both the first element body portion and the second element body portion may contain ZnO as a constituent component, and a ZnO content rate of the first element body portion may be higher than a ZnO content rate of the second element body portion.

In the multilayer coil component according to another aspect, both the first element body portion and the second element body portion may contain NiO as a constituent component, and an NiO content rate of the first element body portion may be lower than an NiO content rate of the second element body portion.

DETAILED DESCRIPTION

Hereinafter, an embodiment of the disclosure will be described with reference to the accompanying drawings. In the description of the drawings, the same elements or elements having the same functions will be denoted by the same reference signs and duplicate descriptions thereof will be omitted.

Figure 1:
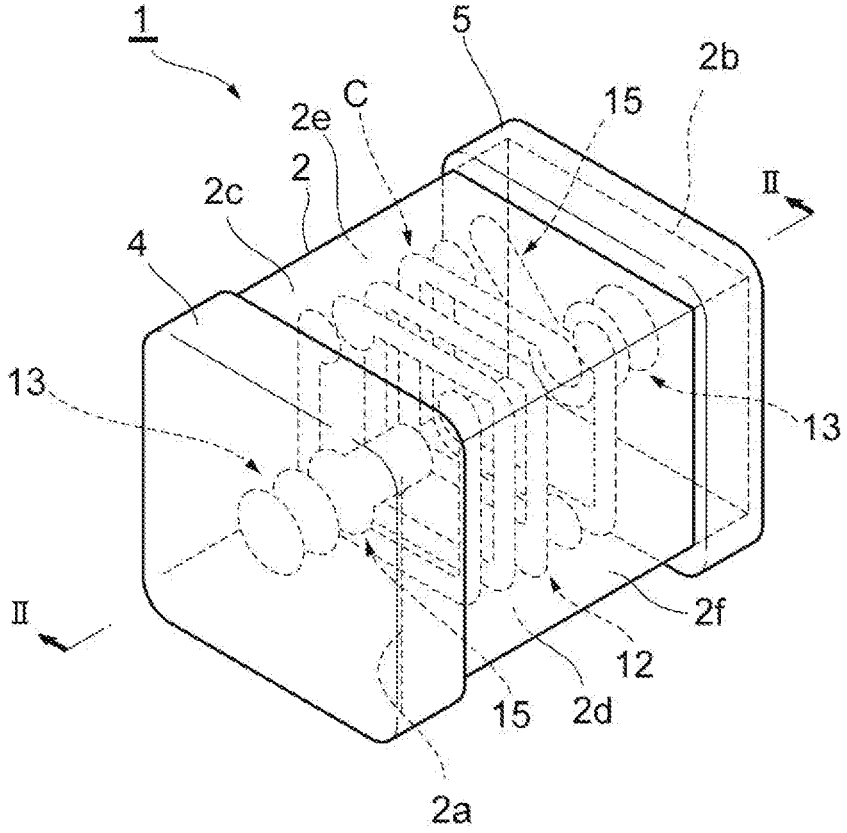
FIG. 1 is a perspective view illustrating a multilayer coil component according to one embodiment.
Figure 2:
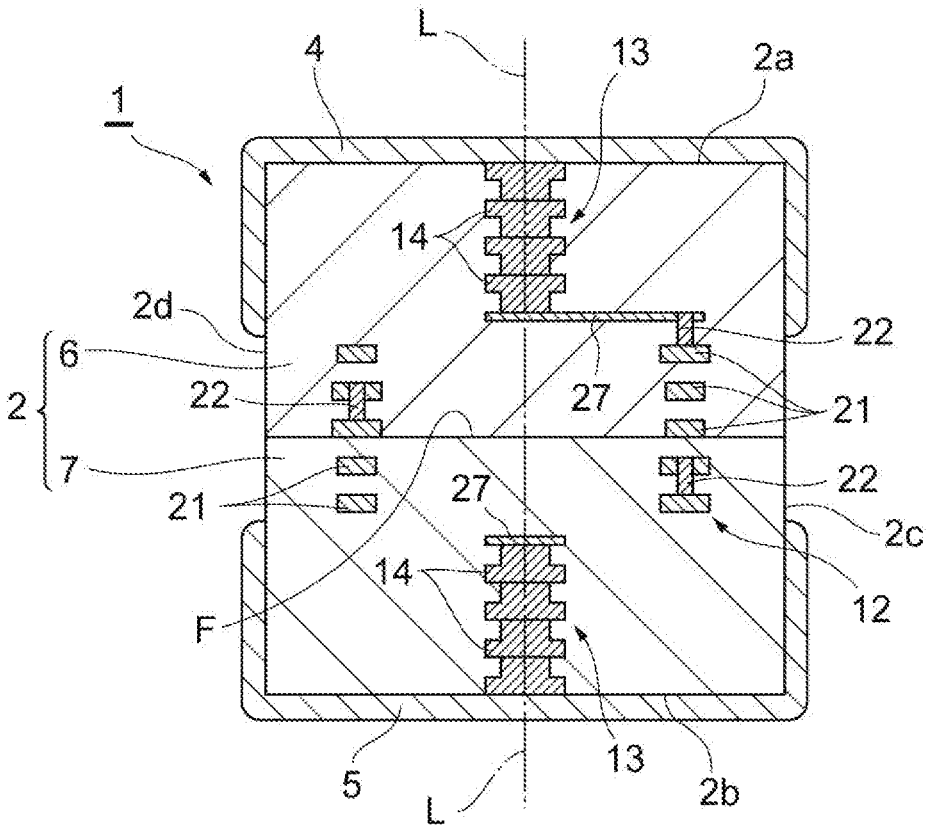
FIG. 2 is a cross-sectional view taken along line II-II of the multilayer coil component illustrated in FIG. 1.

As illustrated in FIGS. 1 and 2, a multilayer coil component 1 includes a ferrite element body 2 having a substantially rectangular parallelepiped shape, and a multilayer coil C formed in the ferrite element body 2.

The ferrite element body 2 is formed of a ferrite element body material containing ferrite as a main component, and can be formed by calcining a laminate in which multilayered green sheets 11A and 11B to be described below are overlapped. Therefore, the ferrite element body 2 can be regarded as a laminate of ferrite layers and has a lamination direction. However, the ferrite layers constituting the ferrite element body 2 can be integrated to such an extent that boundaries therebetween cannot be visually recognized. The ferrite element body 2 has an outer shape of a substantially rectangular parallelepiped shape, and includes, as outer surfaces thereof, a pair of end surfaces 2*a* and 2*b* facing each other in the lamination direction and four side surfaces 2*c*, 2*d*, 2*e*, and 2*f* extending in a direction in which the pair of end surfaces 2*a* and 2*b* face each other to connect the pair of end surfaces 2*a* and 2*b*.

As illustrated in FIG. 2, the ferrite element body 2 includes a first element body portion 6 and a second element body portion 7. The first element body portion 6 and the second element body portion 7 are disposed to be adjacent to each other in the lamination direction of the ferrite element body 2. An interface F between the first element body portion 6 and the second element body portion 7 is positioned at substantially a center of the ferrite element body 2 in the lamination direction and extends perpendicular to the lamination direction.

In the present embodiment, both the first element body portion 6 and the second element body portion 7 are formed of a ferrite element body material containing a Ni—Cu—Zn-based ferrite as a main component, but contents of the constituent components therein are different from each other. Specifically, the ferrite element body material forming the first element body portion 6 contains a main component composed of 37.0 mol % of Fe compounds in terms of $Fe_2O_3$, 8.0 mol % of Cu compounds in terms of CuO, 34.0 mol % of Zn compounds in terms of ZnO, and the remainder being Ni compounds, and accessory components including 4.5 parts by weight of Si compounds in terms of $SiO_2$, 0.5 parts by weight of Co compounds in terms of $Co_3O_4$, and 0.8 parts by weight of Bi compounds in terms of $Bi_2O_3$ with respect to 100 parts by weight of the main component. Also, the ferrite element body material forming the second element body portion 7 contains a main component composed of 45.0 mol % of Fe compounds in terms of $Fe_2O_3$, 8.0 mol % of Cu compounds in terms of CuO, 8.0 mol % of Zn compounds in terms of ZnO, and the remainder being Ni compounds, and accessory components including 1.0 parts by weight of Si compounds in terms of $SiO_2$, 5.0 parts by weight of Co compounds in terms of $Co_3O_4$, and 0.8 parts by weight of Bi compounds in terms of $Bi_2O_3$ with respect to 100 parts by weight of the main component. That is, both the first element body portion 6 and the second element body portion 7 contain ZnO as a constituent component, and a ZnO content rate of the first element body portion 6 is higher than a ZnO content rate of the second element body portion 7. Further, both the first element body portion 6 and the second element body portion 7 contain NiO as a constituent component, and a NiO content rate of the first element body portion 6 is lower than a NiO content rate of the second element body portion 7.

Further, the ferrite element body material forming both the first element body portion 6 and the second element body portion 7 contains $Zn_2SiO_4$ as an accessory component. In the present embodiment, a $Zn_2SiO_4$ content rate of the first element body portion 6 is 17 parts by weight with respect to 100 parts by weight of the ferrite element body material, and a $Zn_2SiO_4$ content rate of the second element body portion 7 is 1 part by weight with respect to 100 parts by weight of the ferrite element body material. That is, the $Zn_2SiO_4$ content rate of the first element body portion 6 is higher than the $Zn_2SiO_4$ content rate of the second element body portion 7.

The multilayer coil C is constituted by a plurality of conductive layers overlapping in the lamination direction of the ferrite element body 2 and has an axis L parallel to the lamination direction of the ferrite element body 2. The multilayer coil C includes a coil winding portion 12 and a pair of lead-out portions 13 extending from each end portion of the coil winding portion 12 to the end surfaces 2*a* and 2*b*. Each of the lead-out portions 13 includes a lead-out conductor 14 and a connection conductor 15. Each conductive layer constituting the multilayer coil C is configured to contain a conductive material such as Ag, Pd, or the like.

Also, the multilayer coil component 1 includes a pair of external electrodes 4 and 5 disposed on both end surfaces 2*a* and 2*b* of the ferrite element body 2, respectively. The external electrode 4 is formed to cover the whole of one end surface 2*a* and some of the four side surfaces 2*c*, 2*d*, 2*e*, and 2*f*. The external electrode 5 is formed to cover the whole of the other end surface 2*b* and some of the four side surfaces 2*c*, 2*d*, 2*e*, and 2*f*. The lamination direction of the ferrite element body 2 coincides with a direction in which the pair of end surfaces 2*a* and 2*b* face each other, and the pair of external electrodes 4 and 5 are respectively disposed at opposite end portions of the ferrite element body 2 in relation to the lamination direction. Further, the respective external electrodes 4 and 5 can be formed by causing the outer surfaces of the ferrite element body 2 to be coated with a conductive paste containing Ag, Pd, or the like as a main component, followed by baking and then electroplating them. For the electroplating, Ni, Sn, or the like can be used.

Figure 3:
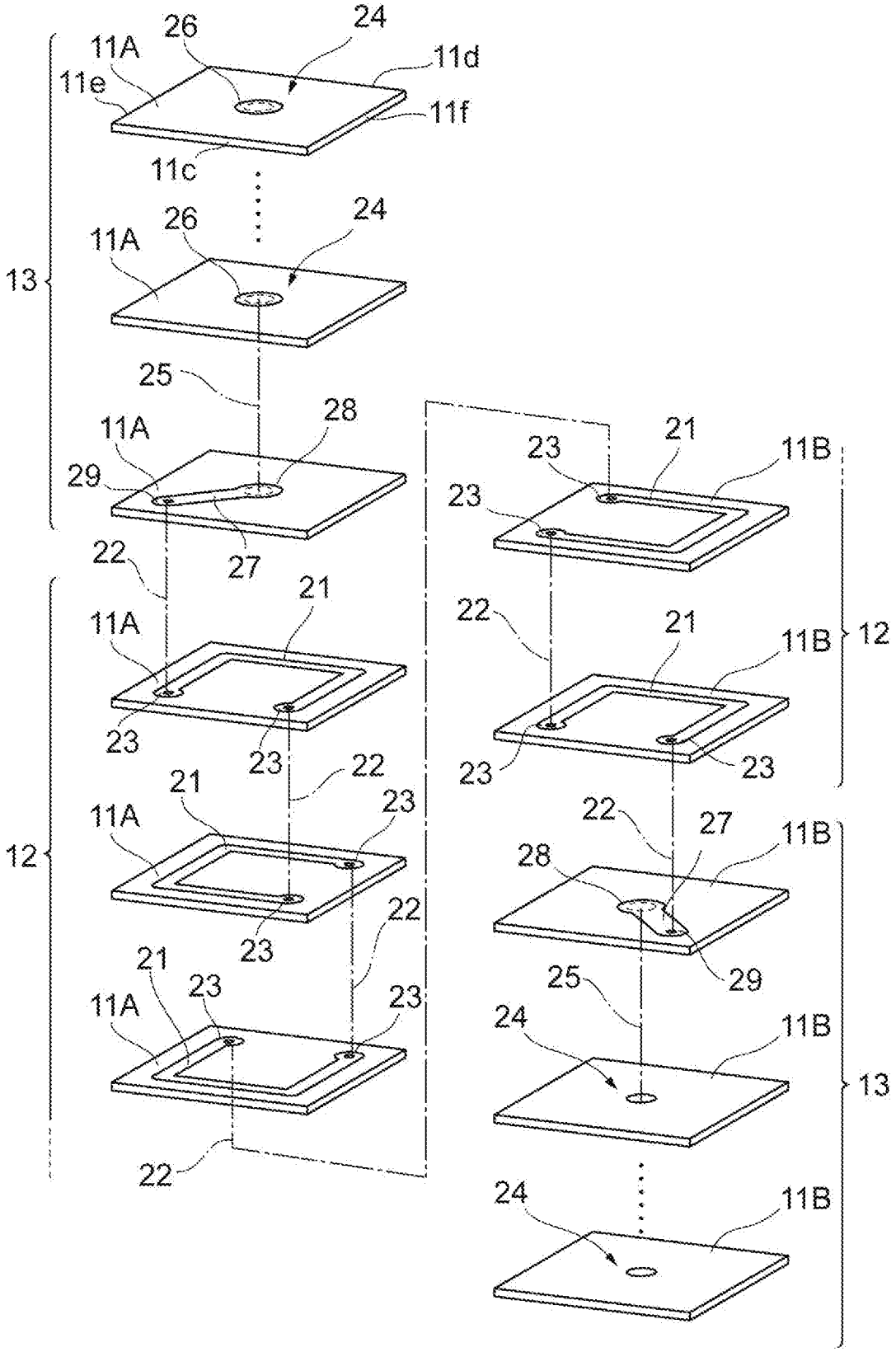
FIG. 3 is a perspective view illustrating a lamination state of green sheets when the multilayer coil component illustrated in FIG. 1 is manufactured.

As illustrated in FIG. 3, the multilayer coil component 1 described above can be formed by calcining a laminate in which multi-layered green sheets 11A and 11B are overlapped.

Each of the green sheets 11A and 11B has a rectangular shape (a square shape in the present embodiment), and includes four sides 11*c*, 11*d*, 11*e*, and 11*f* which define the side surfaces 2*c*, 2*d*, 2*e*, and 2*f* of the ferrite element body 2. The green sheet 11A is a green sheet to be the first element body portion 6 described above, and components thereof have been adjusted for a ferrite layer having a composition of the above-described first element body portion 6 after calcination. The green sheet 11B is a green sheet to be the second element body portion 7 described above, and components thereof have been adjusted for a ferrite layer having a composition of the above-described second element body portion 7 after calcination.

In each of the green sheets 11A and 11B, a conductor pattern to be the above-described conductive layer is formed. Each conductor pattern can be formed by screen printing a conductive paste using screen plate making in which an opening corresponding to the pattern is formed.

Each conductor pattern 21 forming the coil winding portion 12 is formed in substantially a U shape. A substantially circular pad portion 23 corresponding to a through-hole conductor 22 is formed at each of one end portion and the other end portion of the conductor pattern 21. Each of the conductor patterns 21 is connected in series via the through-hole conductor 22 with each of the phases shifted by 90 degrees, and forms the coil C in which the axis L extends in the lamination direction.

A conductor pattern 24 forming the lead-out conductor 14 is formed as a substantially circular pad portion (pad conductor) 26 corresponding to a through-hole conductor 25. That is, the lead-out conductor 14 is constituted by the through-hole conductor 25 and a pad portion 26 provided integrally with the through-hole conductor 25. The pad portion 26 has a larger diameter than the pad portion 23 of the coil winding portion 12 and is disposed coaxially with the axis L of the coil C formed of the coil winding portion 12. Each conductor pattern 24 is connected in series via the through-hole conductor 25, and forms the lead-out conductor 14 extending along the axis L of the coil C. An outer end portion of each lead-out conductor 14 is exposed to each of the end surfaces 2*a* and 2*b* in the lamination direction of the ferrite element body 2, and is connected to each of the external electrodes 4 and 5.

A conductor pattern 27 forming the connection conductor 15 is linearly formed to connect a position corresponding to one pad portion 23 of the coil winding portion 12 and a position corresponding to the pad portion 26 of the lead-out conductor 14. A substantially circular pad portion 28 corresponding to the through-hole conductor 25 is formed to be coaxial with the pad portion 26 of the lead-out conductor 14 in substantially the same shape at one end portion of the conductor pattern 27, and a substantially circular pad portion 29 corresponding to the through-hole conductor 22 is formed to be coaxial with the pad portion 23 of the coil winding portion 12 in substantially the same shape at the other end portion of the conductor pattern 27. One end portion of the conductor pattern 27 is connected to the other end portion of the lead-out conductor 14 via the through-hole conductor 25, and the other end portion of the conductor pattern 27 is connected to an end portion of the coil winding portion 12 via the through-hole conductor 22.

Figure 4:
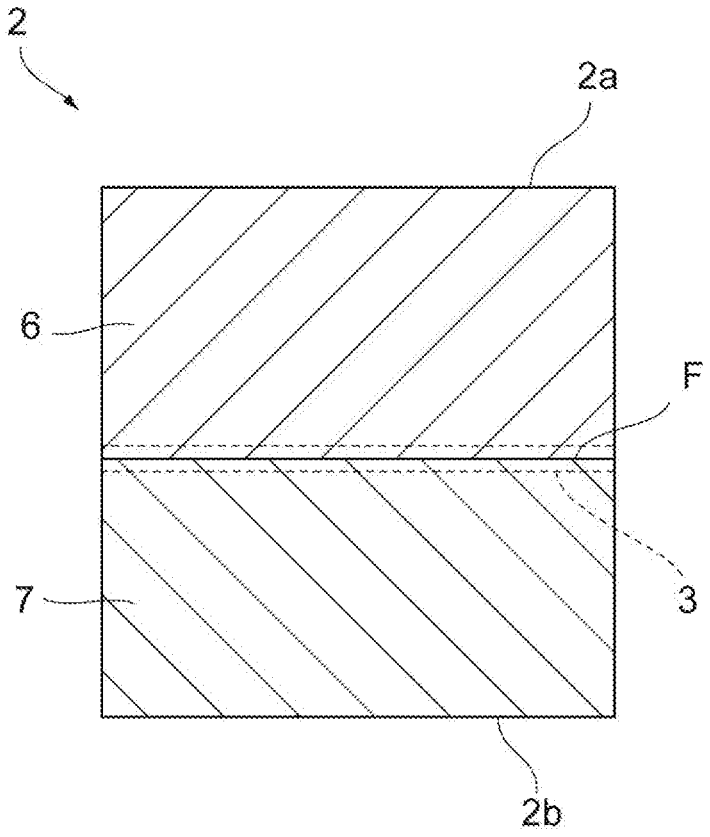
FIG. 4 is a cross-sectional view illustrating a configuration of element bodies of the multilayer coil component illustrated in FIG. 1.

As described above, the first element body portion 6 and the second element body portion 7 can be obtained by calcining the laminate including the green sheets of two types 11A and 11B. As illustrated in FIG. 4, it is thought that a composition gradient layer 3 having a composition gradient in which a composition of one side (for example, a composition of the first element body portion 6) comes closer to a composition of the other side (for example, a composition of the second element body portion 7) from one side toward the other side is formed in the vicinity of the interface F at which the green sheets of two types 11A and 11B switch.

The inventors have newly found that, even when a composition of the first element body portion 6 and a composition of the second element body portion 7 are different from each other as in the ferrite element body 2 described above, a high bonding strength at the interface F between the first element body portion 6 and the second element body portion 7 can be obtained when both the first element body portion 6 and the second element body portion 7 contain $Zn_2SiO_4$ as a constituent component. That is, when the first element body portion 6 and the second element body portion 7 contain $Zn_2SiO_4$, a bonding strength at the interface F is improved compared to a case in which the first element body portion 6 and the second element body portion 7 do not contain $Zn_2SiO_4$.

Therefore, in the multilayer coil component 1, since both the first element body portion 6 and the second element body portion 7 contain $Zn_2SiO_4$ as the constituent component, improvement in bonding strength at the interface F between the first element body portion 6 and the second element body portion 7 is realized.

Figure 5:
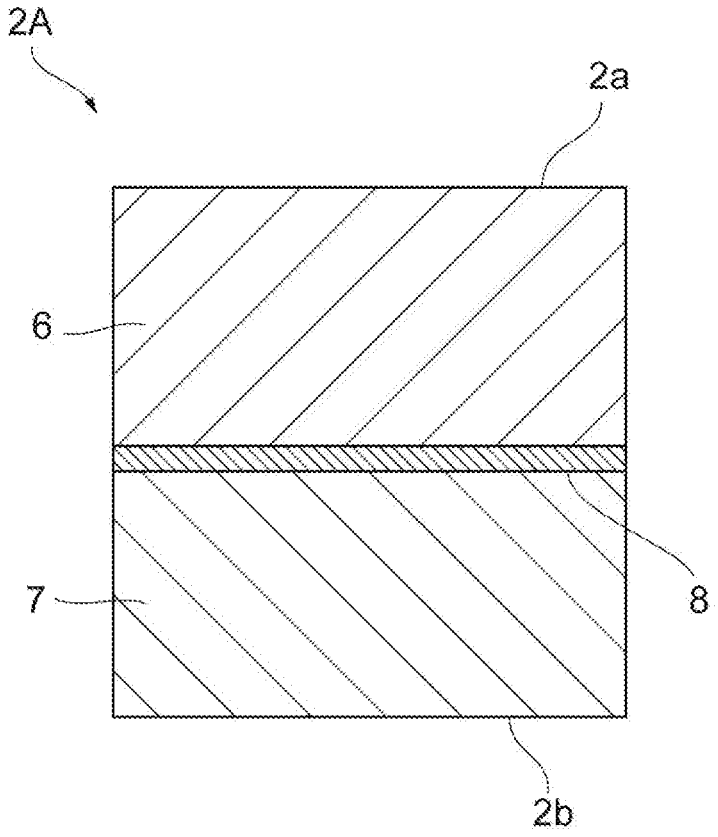
FIG. 5 is a cross-sectional view illustrating ferrite element bodies in a different aspect.

Further, a configuration in which a buffer layer 8 is interposed between the first element body portion 6 and the second element body portion 7 like a ferrite element body 2A illustrated in FIG. 5 may be used. The buffer layer 8 may be, for example, formed of a material such as a mixture of those of the first element body portion 6 and the second element body portion 7. When such a buffer layer 8 is provided, the bonding strength between the first element body portion 6 and the second element body portion 7 can be further improved.

Figure 6:
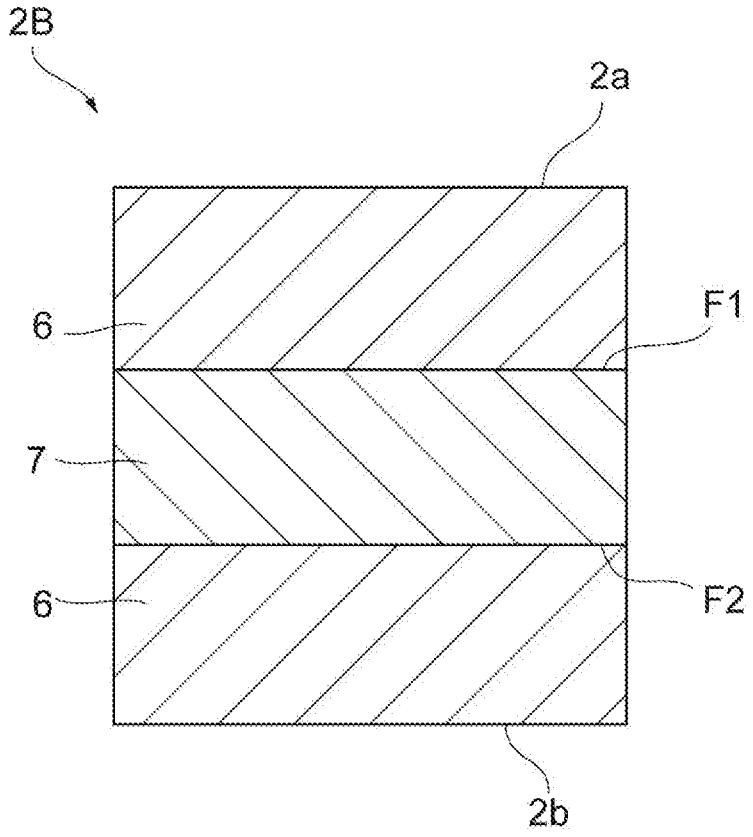
FIG. 6 is a cross-sectional view illustrating ferrite element bodies in another different aspect.

The disclosure is not limited to the above-described embodiment. For example, the ferrite element body is not necessarily constituted by two element body portions, and may be constituted by three or more element body portions. Also in this case, since each element body portion contains $Zn_2SiO_4$, a bonding strength at interfaces between element body portions can be improved. For example, as in a ferrite element body 2B illustrated in FIG. 6, a structure (so-called sandwich structure) in which a second element body portion 7 is sandwiched between two first element body portions 6 in the lamination direction can be used. Also in this case, a bonding strength at each of interfaces F1 and F2 can be improved. Further, since $Zn_2SiO_4$ contained in the first element body portion 6 and the second element body portion 7 has high affinity with a glass component contained in external electrodes 4 and 5, when the external electrodes 4 and 5 are provided at the first element body portion 6 having a higher $Zn_2SiO_4$ content rate between the first element body portion 6 and the second element body portion 7, a bonding strength between the ferrite element body and the external electrode is improved, thereby improving a strength of the terminal.

In the above-described embodiment, although a configuration in which the external electrodes 4 and 5 are respectively disposed on the end surfaces 2*a* and 2*b* of the element body and a so-called longitudinal winding coil in which an extending direction of the axis L of the multilayer coil C extends in the lamination direction of the ferrite element body 2 is connected to the external electrodes 4 and 5 has been described as an example, the coil may be a lateral winding coil, and arrangement positions of the external electrodes 4 and 5 are not particularly limited as long as they are on outer surfaces of the element body.

What is claimed is:

1. A multilayer coil component having a multilayer coil provided in a ferrite element body, wherein the ferrite element body includes a first element body portion, and a second element body portion adjacent to the first element body portion and having a composition different from a composition of the first element body portion, wherein both the first element body portion and the second element body portion contain $Zn_2SiO_4$ as a constituent component, and wherein a $Zn_2SiO_4$ content rate of the first element body portion is higher than a $Zn_2SiO_4$ content rate of the second element body portion.

2. The multilayer coil component according to claim 1, comprising a buffer layer interposed between the first element body portion and the second element body portion.

3. The multilayer coil component according to claim 1, wherein both the first element body portion and the second element body portion contain ZnO as a constituent component, and a ZnO content rate of the first element body portion is higher than a ZnO content rate of the second element body portion.

4. The multilayer coil component according to claim 1, wherein both the first element body portion and the second element body portion contain NiO as a constituent component, and a NiO content rate of the first element body portion is lower than a NiO content rate of the second element body portion.

5. The multilayer coil component according to claim 3, wherein both the first element body portion and the second element body portion contain NiO as a constituent component, and a NiO content rate of the first element body portion is lower than a NiO content rate of the second element body portion.

6. The multilayer coil component according to claim 2, wherein both the first element body portion and the second element body portion contain ZnO as a constituent component, and a ZnO content rate of the first element body portion is higher than a ZnO content rate of the second element body portion.

7. The multilayer coil component according to claim 2, wherein both the first element body portion and the second element body portion contain NiO as a constituent component, and a NiO content rate of the first element body portion is lower than a NiO content rate of the second element body portion.

8. The multilayer coil component according to claim 6, wherein both the first element body portion and the second element body portion contain NiO as a constituent component, and a NiO content rate of the first element body portion is lower than a NiO content rate of the second element body portion.

* * * * *